United States Patent [19]

Ischenko et al.

[11] Patent Number: 4,909,113

[45] Date of Patent: Mar. 20, 1990

[54] DEVICE FOR CLAMPING A CIRCULAR SAW BLADE

[75] Inventors: Anatoly A. Ischenko; Vyacheslav A. Korchagin, both of Zhdanov; Jury E. Kim, Moscow; Ivan F. Dvorzhak, Kramatorsk; Vladimir S. Letyaev, Kramatorsk; Alexandr K. Grebe, Kramatorsk; Albert A. Rybalchenko, Kramatorsk; Vitaly V. Saiko, Kramatorsk, all of U.S.S.R.

[73] Assignee: Mariupolskii Metallurgicheskii Institut, Mariupol, U.S.S.R.

[21] Appl. No.: 265,820

[22] Filed: Nov. 1, 1988

[51] Int. Cl.[4] ..... B27B 5/30

[52] U.S. Cl. ..... 83/698; 83/481; 83/666; 83/676

[58] Field of Search ..... 83/665, 666, 698, 93, 83/676, 481; 403/261, 374

[56] References Cited

U.S. PATENT DOCUMENTS

| | | | |
|---|---|---|---|
| 3,542,097 | 11/1970 | Dudek . | |
| 3,828,632 | 8/1974 | Grano | 83/345 |
| 4,339,893 | 7/1982 | Fournier | 83/666 |
| 4,604,931 | 8/1986 | Bastian et al. | 83/698 X |

*Primary Examiner*—Frank T. Yost
*Assistant Examiner*—Y. Lin
*Attorney, Agent, or Firm*—Fleit, Jacobson, Cohn, Price, Holman & Stern

[57] ABSTRACT

A device for clamping a circular saw blade has a drive plate and a driven plate, a circular saw blade being clamped therebetween. The circular saw blade is clamped by means of clamping members, each being made in the form of a cam clamp. A handle of the clamp is provided with a weight and is received in a radial groove of the driven plate. A rod of the clamp form a threaded joint with the drive plate. In addition, each clamping member is engageable with a spring-biased slide block which interconnects the drive and driven plates.

1 Claim, 2 Drawing Sheets

DEVICE FOR CLAMPING A CIRCULAR SAW BLADE

The invention relates to equipment for rolling mills, and in particular, it deals with devices for clamping a circular saw blade.

FIELD OF THE ART

The invention may be most advantageously used in circular saws for cutting rolled stock.

BACKGROUND OF THE INVENTION

Known in the art is a device for clamping a circular saw blade (SU, A, 891268), consisting of a drive plate mounted on a shaft, a driven plate and a central clamping member in the form of a Belville spring which is connected to a pneumatic or hydraulic cylinder by means of a lever. This construction of the clamping device is inefficient both because of the central clamping which calls for large clamping forces and because of the need to have an auxiliary pneumatic or hydraulic actuator.

Also known in the art is a device for clamping a circular saw blade (SU, A, 1046044) in which a circular saw blade is held between a pair of plates by means of clamping members provided in the peripheral parts of the plates. The clamping members are in the form of spring-biased pins connected to an actuator and interconnecting the drive and driven plates, the pins being received in through holes of the plates.

This construction makes it possible to lower clamping forces at each clamping member in comparison with the central clamping of a circular saw blade, but the design of the clamping members calls for a pneumatic actuator necessary for both clamping and release of the circular saw blade. In addition, this device does not allow a rapid change of a circular saw blade to be carried out since each clamping member is to be brought to the pneumatic actuator and aligned with its piston rod for release. Moreover, in clamping a new circular saw blade, it is necessary to align the holes of the saw blade wih the pins of the clamping members simultaneously at different points. As the circular saw blade is suspended on a cable, it is rather difficult to perform this operation, and it takes much time to change the saw blade. A loss of time for a saw blade change results in downtime of the rolling mill, hence in a decrease in its output.

Known in the art is a device for clamping a circular saw blade (cf. Catalog "Cutting Machines for Rolling Mills" (in Russian), Ed. by A.I. Tselikov. TsNIIINFORMTYaZHMASH A 14–70, Part II. 1971. p. 161).

This clamping device consists of drive and driven plates. The drive plate is rigidly secured to a shaft, and a circular saw blade and the driven plate are mounted on a centering hub of the drive plate. The plates and saw blade have coaxial holes spaced along a circle, and clamping members in the form of circular saw blade fastening bolts are inserted in these holes.

When this device is used, it takes 25 to 30 minutes to change a circular saw blade. This time loss is undesirable as the rolling mill has to be stopped during the saw blade change so that output of the rolling mill is lowered. The time is lost for undoing the bolts, removing them, removing the saw blade and driven plate, installation of the new saw blade and bolt tightening. Time is mainly lost in undoing and tightening of the bolts and in the installation of the saw blade. Since it is not desirable to withdraw the bolts from their holes, two persons should install the bolts on either side of the circular saw blade. But if the bolts are left in their holes, it is difficult to install the circular saw blade because it is necessary to align the saw blade holes with the bolts which move out of their correct position within the limits allowed by clearances, the holes being aligned concurrently with the circular saw blade installation on its seat. In carrying out this operation the circular saw blade can more frequently then not hit at the ends of the bolts to damage the thread which may result in difficulties in running down the nuts.

SUMMARY OF THE INVENTION

It is an object of the invention to improve productivity by reducing time necessary for changing a circular saw blade and to improve labour conditions in changing the circular saw blade.

The invention resides in that in a device for clamping a circular saw blade, comprising a drive plate and a driven plate, a circular saw blade being held therebetween by means of clamping members spaced along a circle, according to the invention, each clamping member is in the form of a rotatable cam clamp positioned outside the driven plate having its cam connected to a handle which is provided with a weight and which is received in a radial groove of the driven plate and to a rod connected to the drive plate by means of a threaded joint, the rotatable cam clamps being engageable with spring-biased slide blocks interconnecting the drive end driven plates.

A device for clamping a circular saw blade according to the invention allows time for changing the saw blade to be halved and improves labour conditions for operating personnel. Even with a single rolling mill, the rolling mill time can be prolonged by 0.5–1 hour a day.

BRIEF DESCRIPTION OF THE DRAWINGS

The invention will now be described in detail with reference to a specific embodiment illustrated in the accompanying drawings, in which.

DETAILED DESCRIPTION OF THE INVENTION

Figure 1:
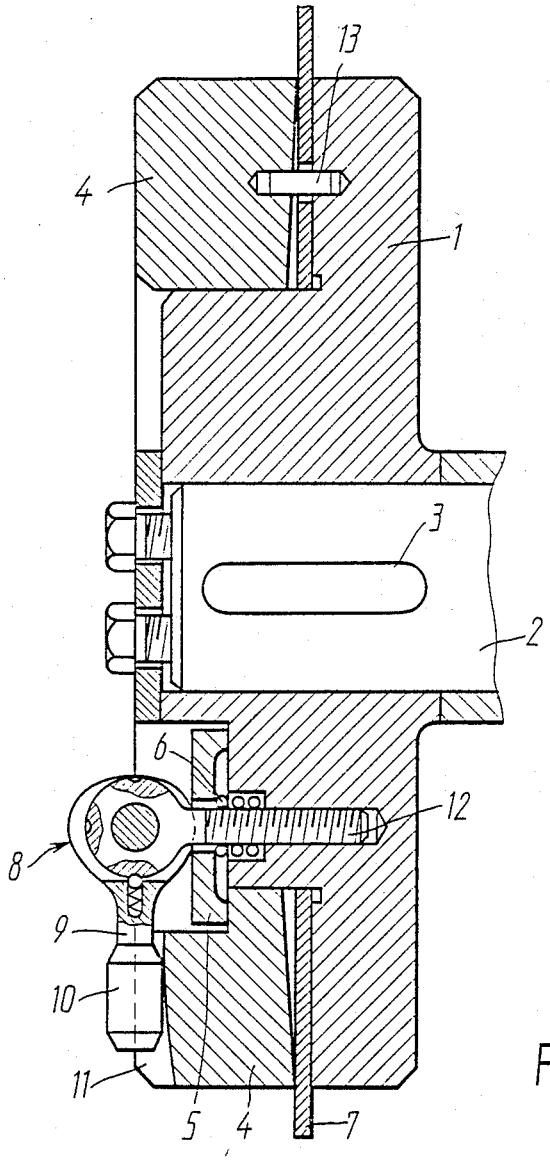
FIG. 1 shows a device for clamping a circular saw blade according to the invention.
Figure 2:
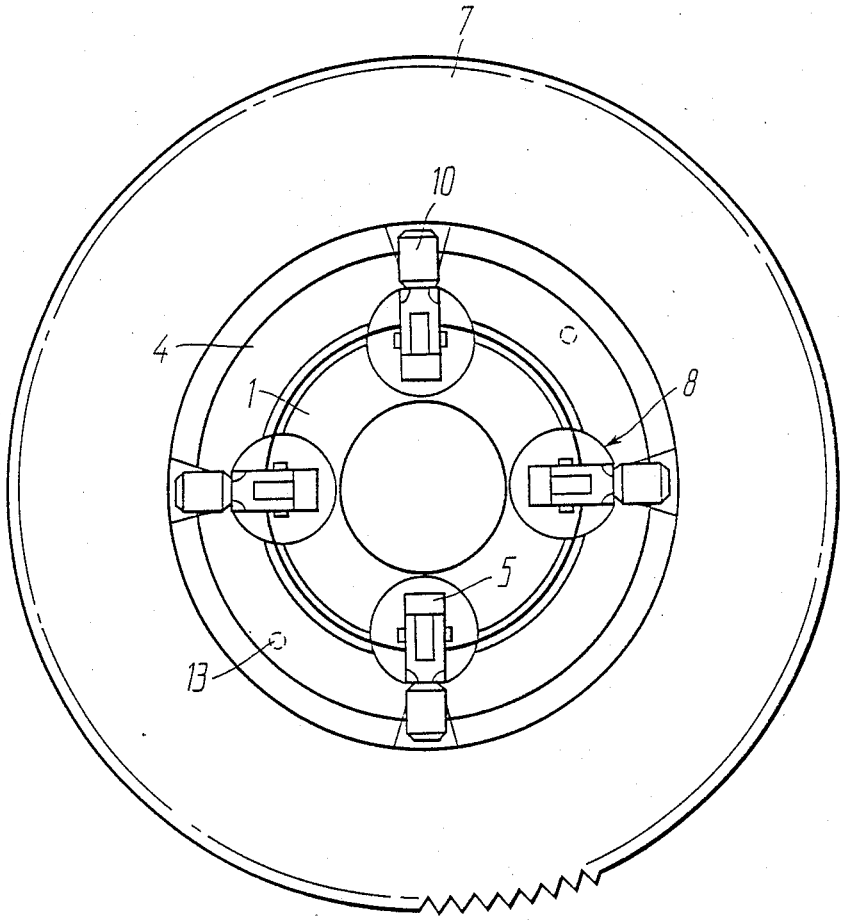
FIG. 2 shows a device for clamping a circular saw blade according to the invention in a side elevation view.

A device for clamping a circular saw blade comprises a drive plate 1 (FIG. 1) mounted on a shaft 2 and connected thereto by means of a key 3, a driven plate 4 connected to the drive plate 1 by means of slide blocks 5 biased by springs 6. Mounted on a seat of the drive plate 1 there is a circular saw blade 7 which is clamped between the plates 1 and 4 (FIGS. 1, 2) by means of circumferentially spaced clamping members (FIGS. 1, 2). Each clamping member is in the form of a rotatable cam clamp positioned outside the driven plate 4 having a cam 8 which is connected to a handle 9 provided with weight 10 and received in a radial groove 11 of the driven plate 4. A rod 12 of the cam clamp is connected to the drive plate 1 by means of a threaed joint. For centering the plates 1 and 4 with respect to the each other and for transmitting torque, there are provided two pins 13 (FIGS. 1, 2).

The device for clamping a circular saw blade according to the invention functions in the following manner.

Before changing the circular saw blade 7 (FIG. 1), a motor (not shown in the drawings) is switched off, and the shaft 2 is stopped. An extension is put on the handle 9 carrying the weight 10 of the cam clamp, and the handle 9 is put into the horizontal position. The slide block 5 is thus disengaged from the cam 8 of the clamp and is raised by the spring 6.

The slide block 5 is then turned through 90°. When this operation is carried out with all clamping members, the driven plate 4 is released and removed by means of a crane. Then the circular saw blade 7 is also removed. The new circular saw blade 7 is installed in the following manner. The circular saw blade 7 is moved by the crane and is installed on a seat of the drive plate 1. Then the saw blade 7 out off the crane is turned on the seat until its holes are aligned with the pins 13. The saw blade 7 is then moved towards the drive plate until it stops. The driven plate 4 is then installed by the crane and is also aligned with the pins 13. The slide blocks 5 are then turned back through 90°, and the handles 9 of the cam clamps carrying the weights 10 are turned to be received in the radial grooves 11 of the driven plate 4. The circular saw blade 7 is now ready for operation.

If the device is used for clamping metal cutting circular saw blades, the saw blade 7 rotates at a high speed, and the handles 9 carrying the weights 10 are retained in the grooves 11 of the driven plate 4 so that there is no need in using any auxiliary devices preventing the cam clamps from opening under emergency or other conditions. At the same time, the fact that the handle 9 is received in the groove 11 of the plate 4 prevents the cam clamp from inedvertent loosening.

If thickness of the circular saw blade 7 has changed or the surface of the cam 8 of the cam clamping member is worn, the clamping force can be adjusted, or the pressure of the slide blocks 5 in general can be ensured by raising or lowering the cam 8 by rotating it in the thread, in it only takes to turn it through 180° since the cam 8 is of a symmetrical, double-action type.

This construction of the device for clamping a circular saw blade makes it possible to achieve a two-fold reduction of time of changing the saw blade 7 by dispensing with undoing and tightening of the nuts and also by eliminating the need to remove clamping members or install the saw blade 7 thereon since the driven plate 4 is clamped by means of the spring-biased slide blocks 5, and the clamping members are not received in the driven plate. In addition, the provision of the handles 9 of the clamping members with the weight 10 and their insertion into the grooves 11 of the driven plate 4 eliminates inadvertent loosening of the clamping members and lifting of the handles 9 so that this facility functions as a protective or safety device and rules out rotation of the cams 8 owing to the action of centrifugal forces on the weight 10 during rapid rotation of the saw blade 7 (100 m/s).

Therefore, time for changing the circular saw blade 7 under high temperature conditions is reduced, whereby, along with the elimination of a tedious operation of nut tightening, labour conditions in changing the saw blade 7 are improved as well.

We claim:

1. A device for clamping a circular saw blade, comprising:

a drive plate for driving the circular saw blade, a driven plate being releasably secured to said drive plate;

clamping members for clamping a circular saw blade between said drive plate and said driven plate and for releasably securing said driven plate to said drive plate;

a rotatable cam clamp of each of said clamping members;

a cam of said cam clamp;

a handle of said rotatable cam clamp received in a groove of said driven plate and connected to said cam;

a weight mounted on said handle;

a rod of said rotatable cam clamp, said rod being connected to said drive plate by means of a threaded joint; and spring-biased slide blocks having two ends and being forced towards said drive plate and said driven plate by said clamping members to secure the circular saw blade therebetween in a normal use position with one of said two ends contacting said drive plate and the other of said two ends contacting said driven plate in the normal use position, and upon release of said clamping members and turning of said slide blocks by 90° so that said two ends are located adjacent said drive plate, said driven plate may be removed for removal of the circular saw blade.

* * * * *